United States Patent [19]

Potts

[11] Patent Number: 4,687,195

[45] Date of Patent: Aug. 18, 1987

[54] TREADMILL EXERCISER

[75] Inventor: Lanny L. Potts, Tulsa, Okla.

[73] Assignee: Tri-Tech, Inc., Tulsa, Okla.

[21] Appl. No.: 577,171

[22] Filed: Feb. 6, 1984

[51] Int. Cl.[4] ..... A63B 23/06

[52] U.S. Cl. ..... 272/69; 272/70

[58] Field of Search ..... 272/69, 70, 93; 184/70 R, 74, 71.1, 184, 187; 193/35 A; 198/327, 326

[56] References Cited

U.S. PATENT DOCUMENTS

| | | | |
|---|---|---|---|
| 1,239,077 | 9/1917 | Begg | 198/327 |
| 1,276,367 | 8/1918 | Ide | 188/84 |
| 3,497,215 | 2/1974 | Harrison et al. | 272/69 |
| 3,592,466 | 7/1971 | Parsons | 272/69 |
| 3,711,812 | 1/1973 | Cherry | 272/69 |
| 3,918,516 | 11/1975 | Isacsson | 193/35 A |

*Primary Examiner*—Richard J. Apley
*Assistant Examiner*—S. R. Crow
*Attorney, Agent, or Firm*—William S. Dorman

[57] ABSTRACT

A treadmill exerciser involving an upwardly and rearwardly sloping treadmill having a plurality of steps which are activated by the weight of a person "walking" up them. The tread portion and the riser portion of each step are connected at both ends by hinges to each other and to endless chains which permit the steps to move or fold around end sprockets as the steps move from an upper inclined course of the chains to a lower inclined return course, and vice versa. A speed control mechanism, driven by one of the chains, employs a gyroscopic flywheel which cooperates with a non-rotatable but axially slidable brake drum to provide even, continuous step movement and a controlled start-up. The flywheel drives a plastic cylinder composed of plastic fingers which fly out, under centrifugal force, into contact with the inner surface of the brake drum thus preventing further increased speed for the user. With the brake drum in one axial position, the plastic fingers become partially disengaged allowing for rapid step speed; when the brake drum is moved to an opposite axial position, step movement is halted. The brake drum can be adjusted to positions between the above two axial positions to provide a controlled speed of movement compatible with the interests or needs of the operator. A control panel, mounted between the top of the tubular handrail shafts, provides operating, goal-setting, and health related information.

6 Claims, 15 Drawing Figures

TREADMILL EXERCISER

BACKGROUND OF THE INVENTION

1. Field of the Invention

The present invention relates to a treadmill exerciser. More particularly, the present invention relates to a treadmill exerciser involving an upwardly and rearwardly sloping treadmill having steps thereon and wherein the treadmill is put into motion by the weight of a person "walking" up the steps.

2. Prior Art

Treadmill exercisers are well known in the art. Drake U.S. Pat. No. 2,399,915 issued on May 7, 1946 discloses a treadmill exerciser wherein the treadmill portion is oriented in a substantially horizontal disposition. Harrison et al U.S. Pat. No. 3,497,215 shows a treadmill exerciser which is rearwardly and upwardly sloping and which, broadly, involves a plurality of movable steps which are moved downwardly and forwardly by the weight of the exerciser in an attempt to clibm up the steps. Parsons U.S. Pat. No. 3,592,466 issued on July 13, 1971 is similar to the aforementioned Harrison et al patent. None of the above references, however, disclose steps where the step portion and riser portion are connected at both ends by hinges which permit the steps to move or fold around the sprockets as the steps move from an upper inclined course to a lower inclined return course, and vice versa.

SUMMARY OF THE INVENTION

The present invention relates to a treadmill exerciser involving an upwardly and rearwardly sloping treadmill having a plurality of steps which are activated by the weight of a person "walking" up them.

The treadmill exerciser includes a frame shaped in the form of a staircase and having necessary braces and support structures. A plurality of movable hinged steps are supported from a larger inclined brace located at each side of the frame extending from an upper juncture of braces to a lower position just above the bottom of the frame.

Two pairs of pillow blocks for rotatably supporting upper and lower sprocket shafts are secured to the underside of the inclined braces. A pair of endless chains is supported around the sprockets which are mounted on the ends of the sprocket shafts. The chains are composed mainly of conventional links; however, "special" links, which allow the horizontal tread portions and the vertical risers to travel around the sprockets, are placed at predetermined locations along each chain and are spaced equidistant from each other.

Each "special" link is comprised of a pair of small rectangular plates; each plate has three spaced holes therein. The outer holes are adapted to surround and engage the end shafts of a pair of adjacent "normal" links; the central hole receives the ends of a hinge shaft. The end shafts of the "normal" links would be lengthened and flattened at their ends to hold the plates in position. The ends of the hinge shafts are provided with rollers which are adapted to ride over the surface of inclined plates which are welded to a portion on the upper surface of the inclined brackets.

The treadmill also includes a plurality of steps which are composed of (normally) horizontal tread portions and (normally) vertical risers. The upper end of each riser is connected to the outer end of each tread portion by means of a piano hinge whose mating parts are attached to the tread and riser. The lower end of each riser is connected to the rear end of each tread portion by another piano hinge which is received on a hinge shaft. Spacing between the hinge shaft and adjcent sprocket shafts is similar to spacing between shafts of any given "normal" link except for the inclusion of the "special" links which travel around the sprockets just as if the chains were composed entirely of "normal" links. The tread and riser portions fold to an acute angle when they traverse around a sprocket whereas they are normally at right angles along the straight portion of the chain between sprockets.

A second smaller chain connects around a smaller sprocket on the upper sprocket shaft and a still smaller sprocket on a speed control mechanism. The speed control mechanism employs a gyroscopic flywheel which is driven by the small sprocket on the speed control mechanism and which cooperates with a non-rotatable but axially slidable brake drum to provide even, continuous step movement and a controlled start-up. The flywheel drives a plastic cylinder comprised of plastic fingers which fly out, under centrifugal force, into contact with the inner surface of the brake drum, thus preventing further increased speed for the user. When the brake drum is moved to one axial position by the operator, the plastic fingers become partially disengaged allowing for rapid step speed; when the brake drum is moved to an opposite axial position, step movement is halted.

A control panel, mounted between the top of a pair of tubular handrail shafts, provides operating, goal-setting, and other health related information.

DETAILED DESCRIPTION OF THE PREFERRED EMBODIMENTS

Figure 2:
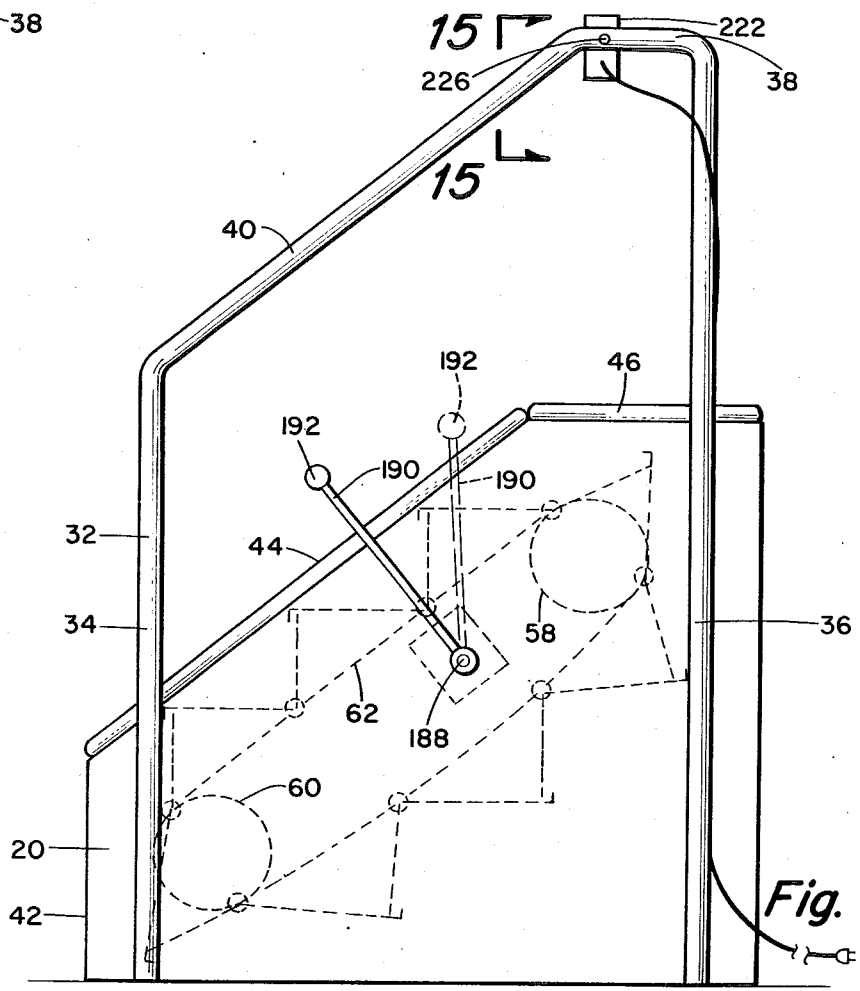
FIG. 2 is a right side elevation from FIG. 1 showing certain hidden parts in dotted lines and an alternate position of the control handle in dashed lines.
Figure 1:
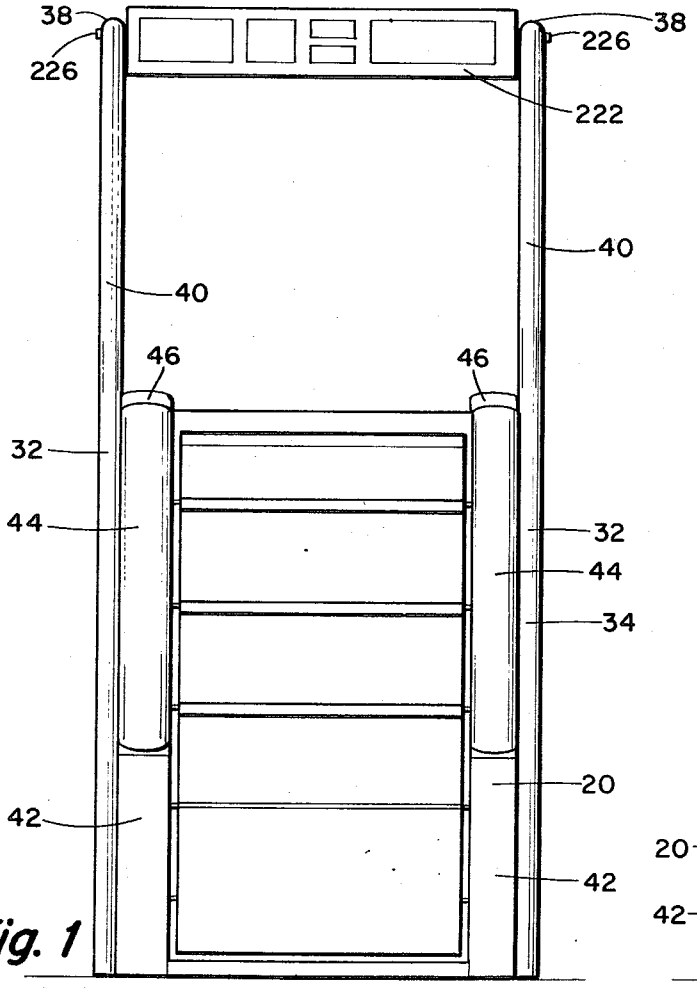
FIG. 1 is a front elevation of a treadmill exerciser constructed in accordance with the present invention.
Figure 3:
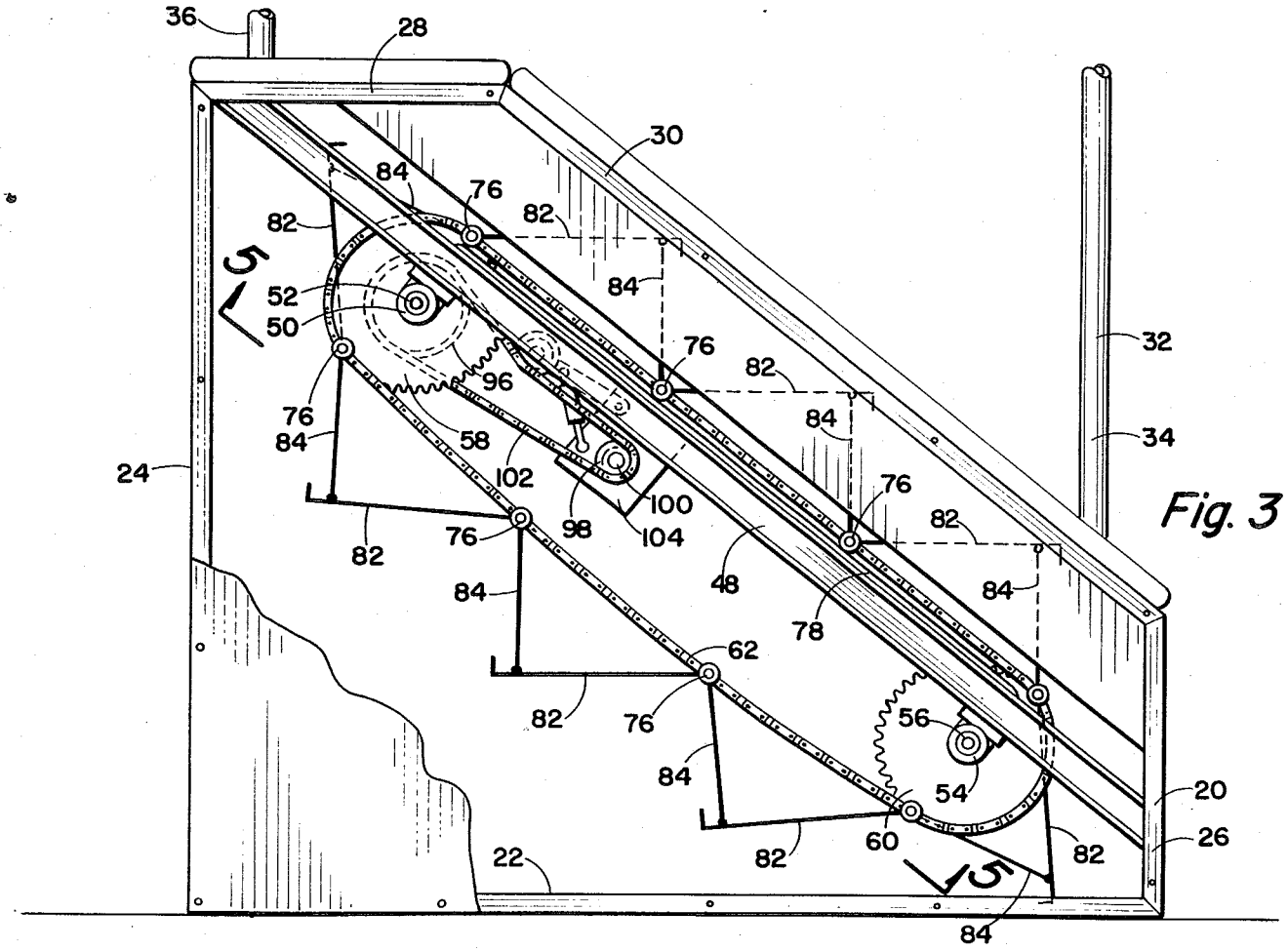
FIG. 3 is a left side elevation from FIG. 2, on an enlarged scale, with a portion of the side cover removed to show internal details and with certain hidden parts being shown in dotted lines.

Referring to the drawings in detail, FIGS. 1-3 show a frame 20 shaped in the form of a staircase and including lower horizontal braces 22 (only one of which is shown in FIG. 3), a pair of rear vertical braces 24 (only one of which is shown in FIG. 3), a pair of shorter front vertical braces 26 (only one of which is shown in FIG. 3), a pair of upper shorter horizontal braces 28 (only one of which is shown in FIG. 3), and a pair of inclined braces 30 (only one of which is shown in FIG. 3) connecting between the forward ends of the braces 28 and the upper ends of the braces 26. Cross braces (not shown) are provided where necessary. Attached to the sides of the frame 20 are a pair of tubular members 32 which are bent in a general U-shape so as to constitute front vertical tubular sections 34, rear vertical tubular sections 36, short horizontal tubular sections sections 38 and inclined tubular sections 40 constituting hand rails for the person operating the treadmill exerciser. The exposed edges of the sides of the staircase can be covered with ash trim pieces 42, 44, and 46, if desired.

A larger inclined brace or channel piece 48 is located at each side of the frame extending from an upper location at the juncture of braces 24 and 28 to a lower position just above the bottom of the front vertical brace 26. Most of the elements associated with the movable hinged steps, as will hereinafter appear, are supported from these inclined braces 48. A pair of pillow blocks 50 for rotatably supporting an upper sprocket shaft 52 are secured to the underside of the inclined braces 48 below the upper ends thereof. A similar set of pillow blocks 54 for supporting a lower sprocket shaft 56 are attached to the underside of the braces 48 above the lower ends thereof. A pair of upper sprockets 58 are attached to the upper sprocket shaft 52 adjacent the pillow blocks 50. A pair of lower sprockets 60 are attached to the sprocket shaft 56 adjacent the pillow blocks 54. A large pair of chains 62 are supported around the sprockets 58 and 60. Each of the larger chains 62 is composed mainly of conventional links 64; however, at predetermined locations along each chain 62, and spaced equidistant from each other are "special" links 66 which will now be described in greater detail.

Figure 6:
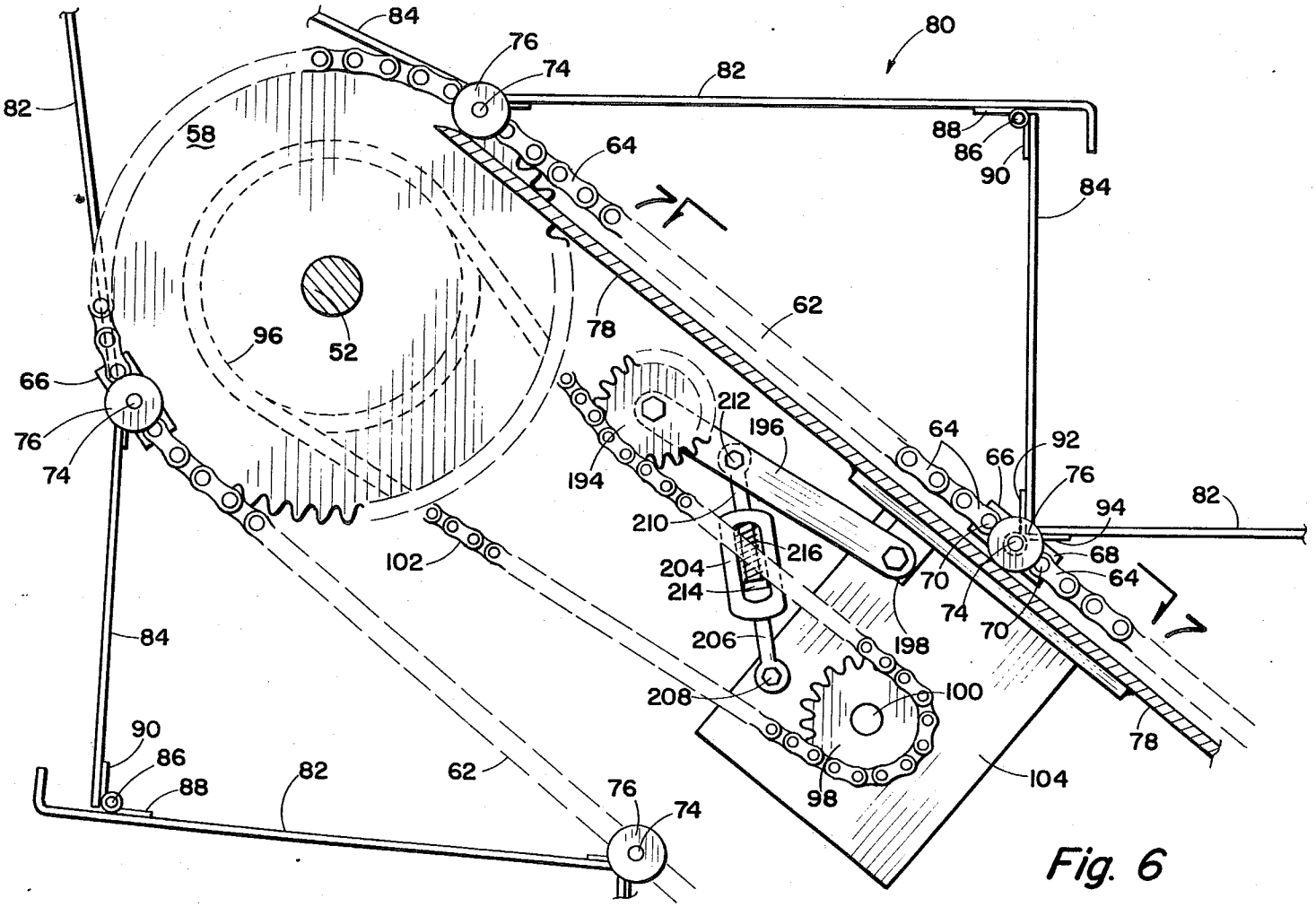
FIG. 6 is a detail, on an enlarged scale, taken from FIG. 3 showing the upper portion of the chain drive and the connection to the speed control device.
Figure 13:
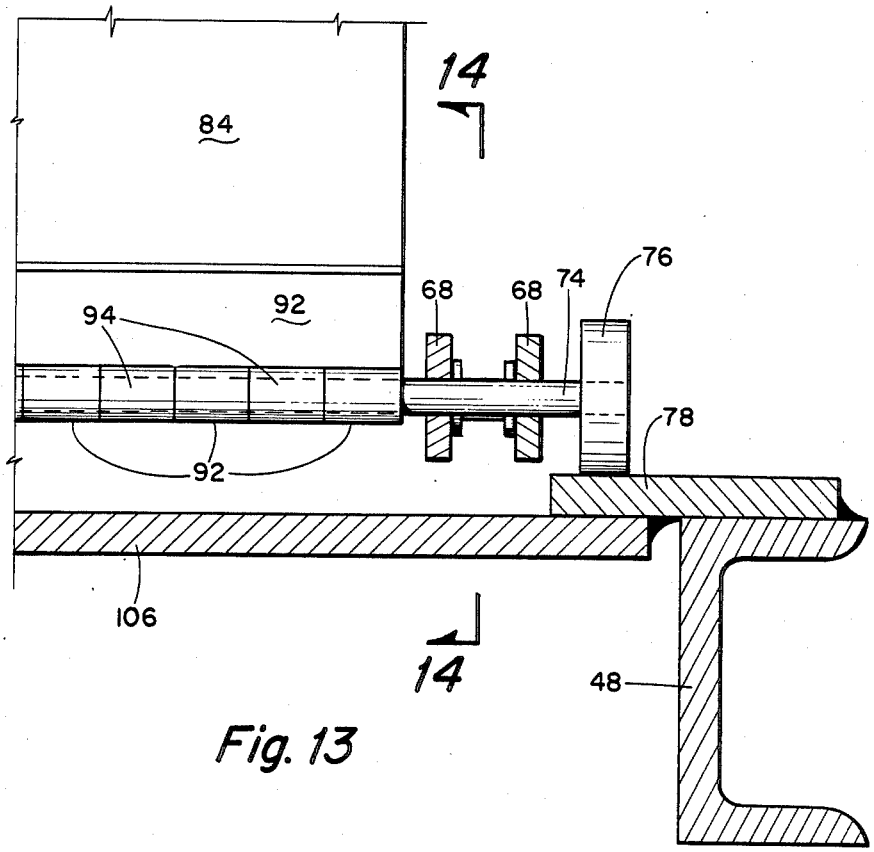
FIG. 13 is a cross sectional view, on an enlarged scale, of a portion of a step and associated driving structure taken along section line 13—13 of FIG. 5.
Figure 14:
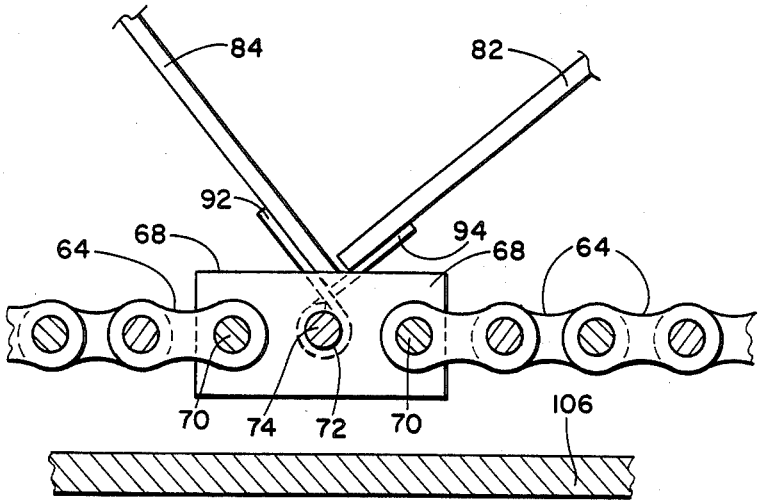
FIG. 14 is a sectional view taken along section line 14—14 of FIG. 13.

Referring now to FIGS. 6, 13, and 14, each "special" link 66 is comprised of a pair of small rectangular plates 68 having three spaced holes therein. The outer holes (not referenced) are adapted to surround the engage the end shafts 70 of a pair of adjacent "normal" links 64, whereas the central hole 72 receives the ends of a first hinge shaft 74. The end shafts 70 of the "normal" links would be lengthened and flattened at their ends to hold the plates 68 in the positions shown in FIGS. 6, 13, and 14. The ends of the hinge shafts 74 are provided with rollers 76 which are adapted to ride over the surface of inclined plates 78 which are welded to a portion of the upper surface of the inclined brackets 48.

The treadmill device of the present invention includes a plurality of steps 80 which are composed of (normally) horizontal tread portions 82 and (normally) vertical risers 84. As shown in FIG. 6, the upper end of each riser 84 is connected to the outer end of each tread portion by means of a second hinge shaft 86 which connects with the tread and the riser by means of a pair of piano hinges 88 and 90 which are attached to the tread and riser respectively and which are received on the hinge shaft 86. Considering FIGS. 6, 13, and 14 together, the lower end of each riser 84 is connected to the rear end of each tread portion by means of a pair of piano hinges 92 and 94, respectively, which are received on the first mentioned hinge shaft 74. The spacing between the hinge shaft 72 and the adjacent sprocket shafts 70 is the same as the spacing between the shafts of any given normal link such that the "special" link 68 will travel around the sprockets 58 and 60 just as if the chains 62 were composed entirely of normal links 64. The provision of hinges at both ends of the risers and treads permits the steps to travel around the sprockets as shown in FIG. 6.

As shown in the upper portions of FIGS. 3 and 6, when two adjacent hinge shafts 74 and their associated rollers 76 are disposed along a sprocket diametrically opposite from each other, they are circumferentially spaced from each other along the curved chain the same distance as they would be on a straight chain portion; however, they are physically closer to each other by a distance approximately equal to the diameter of the sprocket 58 which means that the steps would bend or break in the absence of the hinges 74 and 86. As best shown in the upper portion of FIG. 3, the tread portion 82 and the riser portion 84 are at an acute angle whereas they are normally at right angles along a straight portion of the chain between the sprockets.

Figure 5:
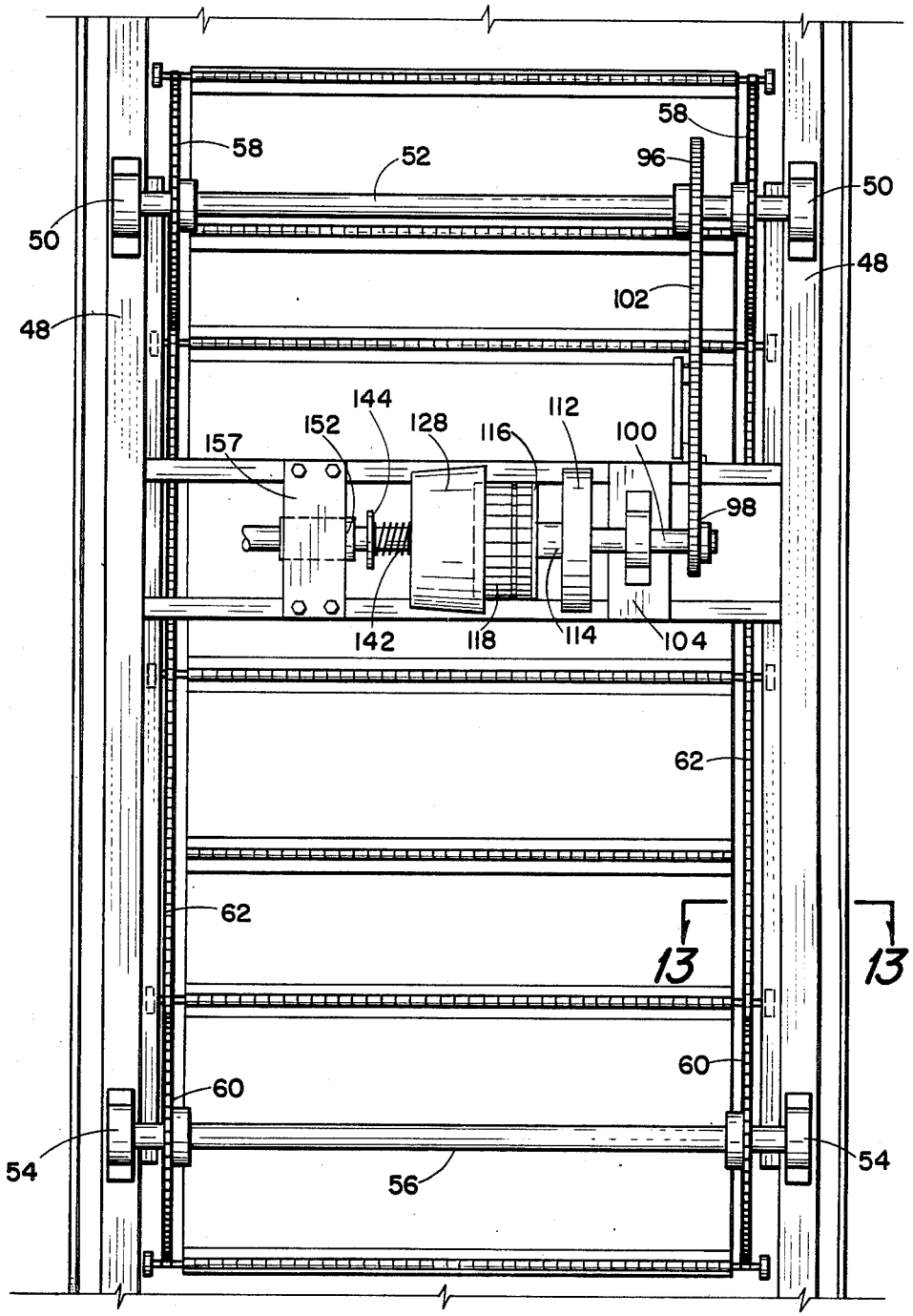
FIG. 5 is a view, on an enlarged scale, of the underside of the chain drive, looking along line 5—5 of FIG. 3, and with the lower flights of stairs removed.
Figure 7:
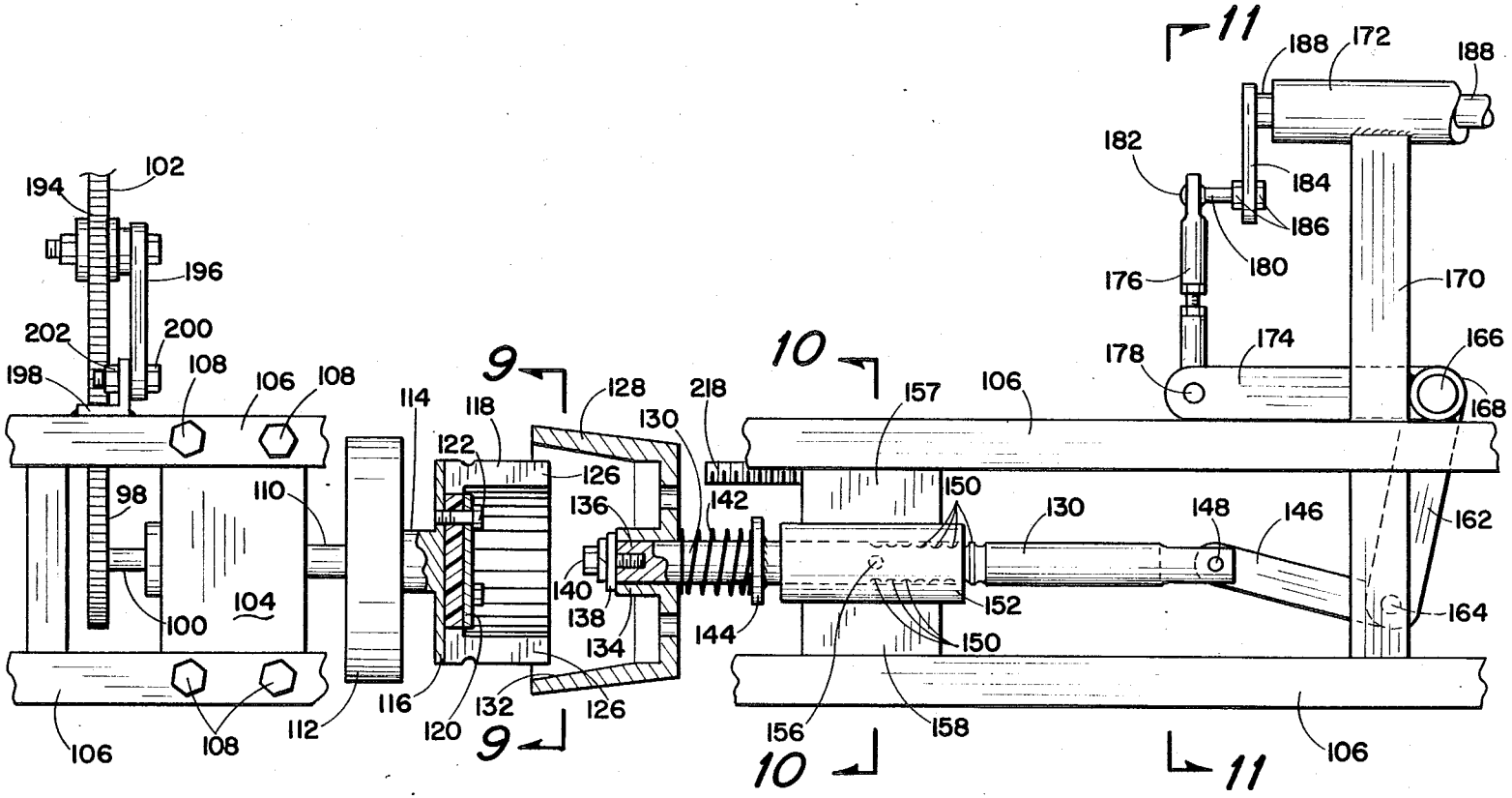
FIG. 7 is a detail of the speed control device taken along line 7—7 of FIG. 6 and turned 90°.
Figure 8:
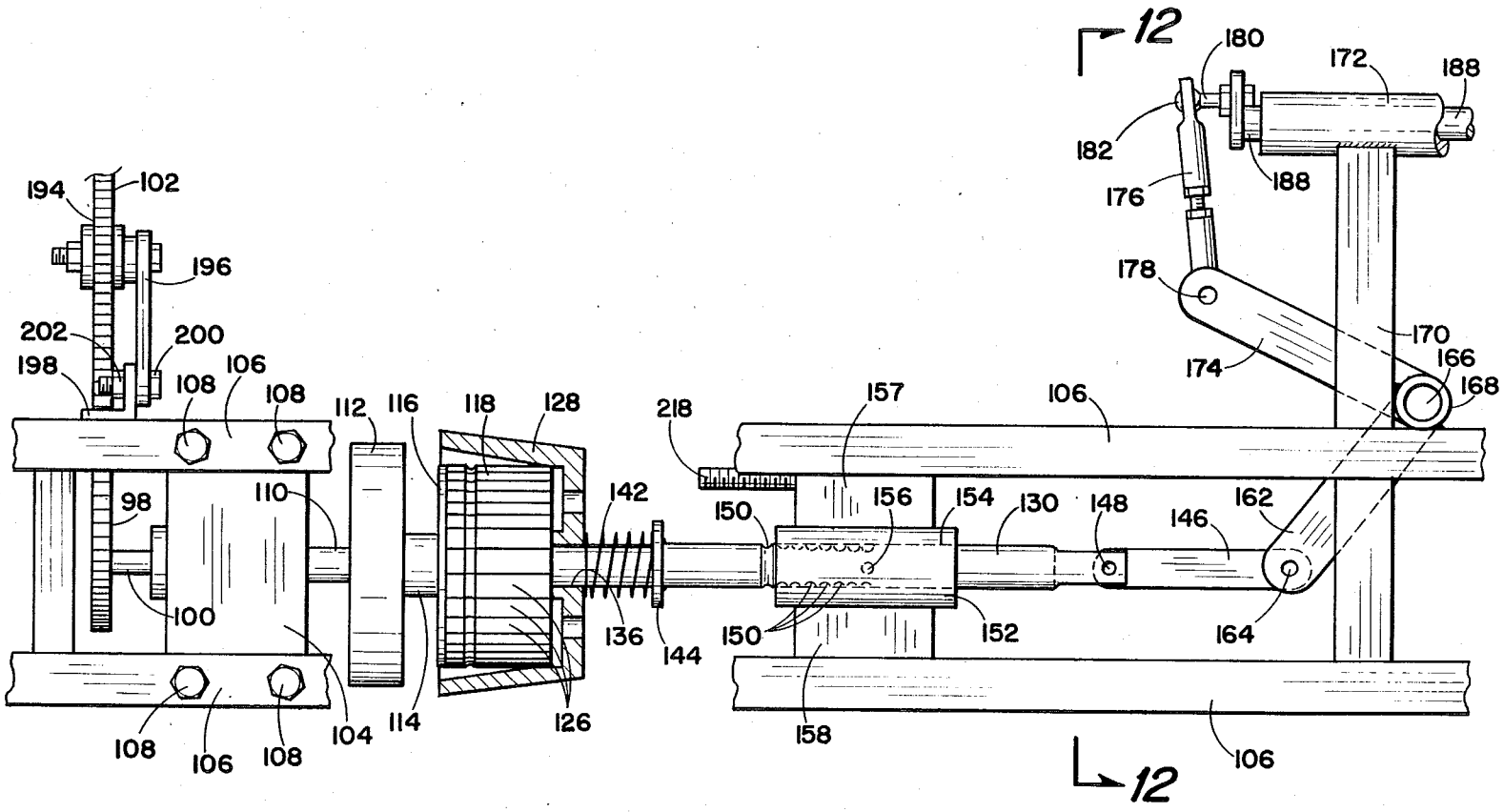
FIG. 8 is a view similar to FIG. 7 showing the speed control device in the braked position.
Figure 11:
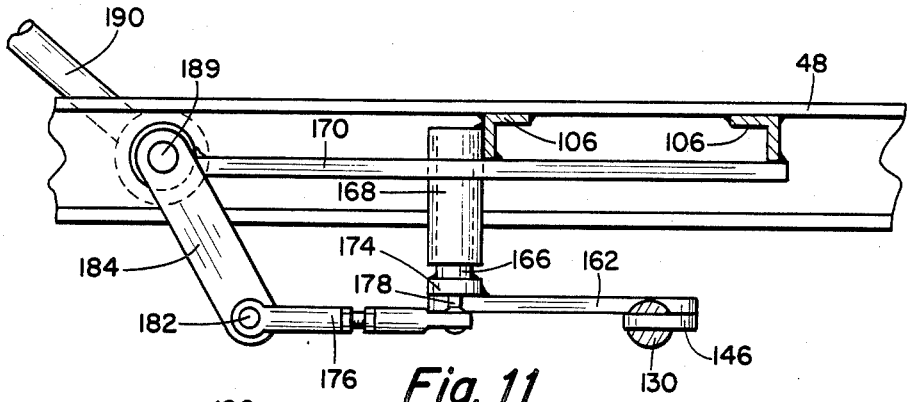
FIG. 11 is a sectional view taken along section line 11—11 of FIG. 7 showing the handle and its associated linkage in the brake released position.
Figure 12:
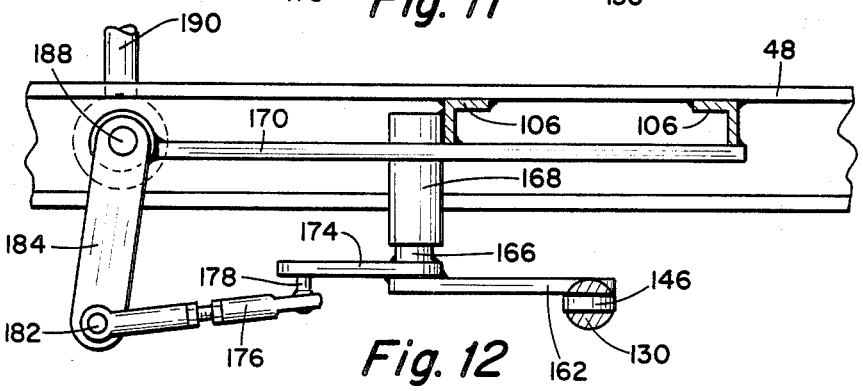
FIG. 12 is a view taken along line 12—12 of FIG. 8, showing the same elements as depicted in FIG. 11 in the braked position.

The speed control mechanism is shown in FIGS. 3, 5, and 6 and in greater detail in FIGS. 7 and 8. A sprocket 96 (shown in dotted lines in FIGS. 3 and 6) is keyed to the sprocket shaft 52 inboard of the right hand sprocket 58 shown in FIG. 5. This sprocket 96 is preferably of smaller diameter than the sprocket 58. A still smaller sprocket 98 is keyed to a speed control shaft 100 and a chain 102 surrounds these sprockets so as to place the sprocket 96 in driving relation with the sprocket 98. The speed control shaft 100 constitutes the input shaft to a step-up transmission 104 which is bolted to a pair of horizontal L-shaped braces 106 by means of bolts 108. The ends of the horizontal braces 106 are connected to the inclined channels 48 by welding the ends thereof to the undersides of the inclined plates 78 as shown in FIG. 13 or, if desired, they could be welded or bolted directly to the inclined channels 48.

Figure 9:
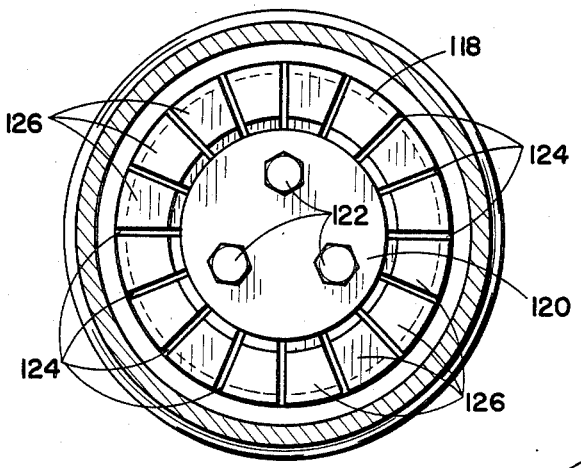
FIG. 9 is a sectional view, on an enlarged scale, taken along section line 9—9 of FIG. 7 showing the relationship between the stationary brake drum or cup and the braking cylinder attached to the flywheel.

The transmission 104 has an output shaft 110 which connects with a flywheel 112. Purely for the sake of description, and not by way of limitation, the step-up relationship in the transmission 104 is such that the flywheel 112 will rotate at 24 times the speed of the input shaft 100. The flywheel has an integral output shaft 114 which is attached to a disk 116 spaced to the right of the flywheel 112 as shown in FIGS. 7 and 8. A cylindrical plastic member 118 is bolted to the plate 114 and held in position against the plate by means of a metal disk 120 and three screws 122 which pass through suitable holes in the disk 120 and which are received in threaded openings in the circular plate 114. As best shown in FIG. 9, the plastic cylinder 118 is provided with a plurality of longitudinal slits or slots 124 such that the portion of the plastic cylinder 118 extending towards the right in FIGS. 7 and 8 is comprised of a plurality of flexible plastic fingers 126.

Figure 10:
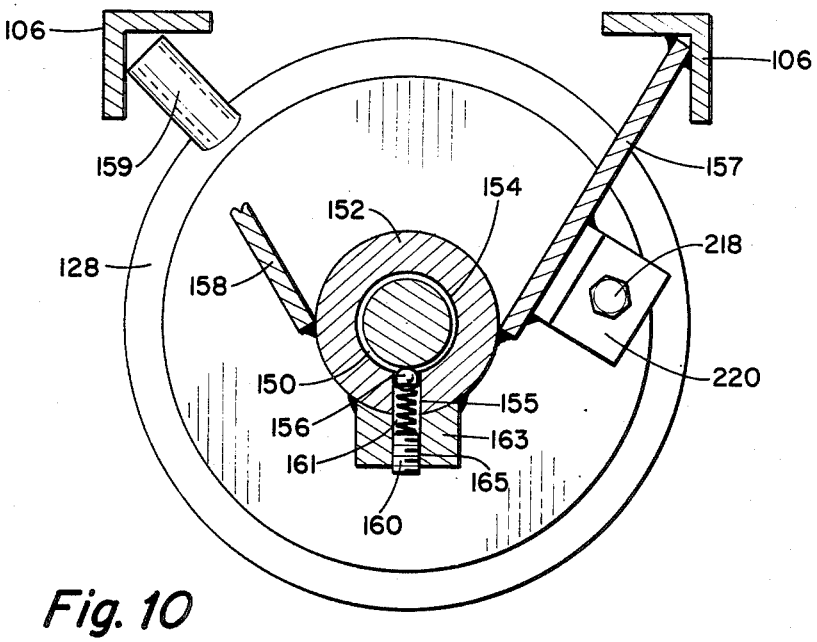
FIG. 10 is a sectional view taken along section line 10—10 of FIG. 7 and turned 90°.

Spaced to the right of the plastic cylinder 118 is a bell-shaped brake drum 128 which is keyed to a non-rotatable shaft or rod 130. The brake drum 128 has an internal tapered or inclined surface 132 (whose purpose will hereinafter appear) and a boss 134 in which there is a hole or bore 136 which receives the brake drum 128 on the shaft 130. A washer 138 is received on the left hand end of the rod 130 and a screw 140 holds the washer 130 in position to prevent removal of the drum 128 from the rod 130. A spring 142 bears against the right hand end of the brake drum 128 and against the left hand end of a flange or shoulder 144 provided on the rod 130. Thus, the drum 128 can be urged towards the right if a sufficient force is exerted against it, but the spring 142 continuously urges the drum 128 towards the left. The rod 130 extends to the right where it connects with a link 146 by means of a pin 148. A portion of the rod 130 between the shoulder 144 and the chain 148 is provided with a plurality of annular grooves 150 some of which are shown in dotted lines. This grooved portion passes through a cylindrical member or sleeve 152 which is welded to a pair of braces 157 and 158 which are, in turn, welded to the two L-shaped 106, as best shown in FIG. 10. The brace 157 is clearly shown as welded between the sleeve 152 and the right hand brace 106 in FIG. 10; a portion of the other brace 158 has been cut away to reveal a finger 159 which is secured to the outer periphery of the brake drum 128 and which is positioned in the "L" of the left hand brace 106. The purpose of the finger 159 is to prevent the drum from rotating on the shaft or rod 130. Therefore, it should be understood that the brace 158 is welded to the left hand brace 106 in the same manner that the brace 157 is welded to the right hand brace 106.

The cylindrical member 152 is provided with a cylindrical bore 154 therein ad a ball 156 is mounted in a suitable radial opening 155 which communicates with the bore 154. A spring 161 is also mounted in this radial bore 155 to vary the force or pressure exerted against the ball 156 as it is urged into one of the grooves 150. A small rectangular block 163 is welded to the outside of the sleeve 152 as shown in FIG. 10, and this block is provided with a threaded hole 165 in alignment with the hole or bore 155. An external adjustment screw 160 received in the threaded hole 165 can be used to vary the compression of the spring 161 on the ball 156 in a conventional manner.

The other end of the link 146 described above is pivotally connected to an arm 162 by means of a pin 164. The other end of the arm 162 is attached to a shaft 166 which is rotatably mounted in a bushing 168 which is welded to a horizontal brace 106. The bushing 168 is also welded to a strut 170 which connects across the horizontal braces 106 and extends upward to a shaft housing 172. A second arm 174 is also connected to the shaft 166. Together the arms 162 and 174 constitute a crank arm. The other end of the arm 174 connects with an adjustable link 176 by means of a ball connection 178. The other end of the adjustable link 176 connects with a lug 180 by means of a universal ball connection 182. The lug 180 is attached at right angles to one end of a link or arm 184 by means of nuts 186. The other end of the arm 184 is attached to a shaft 188 which is rotatably received in the shaft housing 172. The outer end of the shaft 188 is connected toa control handle 190 which has a knob 192 on the outer end.

In order to keep the chain 102 taut, an idler sprocket 194 is mounted so as to engage the chain 102 between the sprockets 96 and 98. More particularly, sprocket 194 is mounted on one end of an idler arm 196 the other end of which is pivotally connected to a small L-shaped bracket 198 which is welded to one of the braces 106. The pivotal attachment of the arm 196 to the bracket 198 is accomplished by bolt 200 and nut 202. In order to urge the sprocket 196 resiliently into engagement with the chain 102, there is provided a spring housing 204 having a stationary rod 206 at one end thereof and pivotally connected at its lower end to the transmission housing 104 by means of a screw 208. At the other end of the spring housing is mounted a slidable rod 210 which is pivotally connected at its outer end to the arm 196 by means of the screw 212. The lower inner end of the rod 210 is provided with an integral circular plate 214. A spring 216 mounted within the spring housing 204 bear against the inner upper end of the housing 204 and the top of the plate 214 so as to urge the rod 210 downward and, hence, urge the idler sprocket 194 resiliently into engagement with the chain 102.

When an exerciser steps on the treads 82 and the brake is in the position shown in FIG. 7, the steps will move at a relatively rapid rate until the fingers 126 of the plastic brake drum 118 fly out, under centrifical force, to contact the surface 132 of the brake drum 128 at which time the brake drum will prevent any further increase in speed; however, if the exerciser moves the handle to the position shown in dotted lines in FIG. 2, the brake drum will move to the position shown in FIG. 8 to stop the movement of the steps. If the brake drum in FIG. 7 were moved to the right by moving the rod 130 to the right such that the fingers 126 of the plastic brake 118 could no longer contact the drum 128, then the speed of the steps would become very rapid and possibly excessive for the exerciser. When moving the rod 130 towards the right or towards the left, the ball 156 will engage successive grooves 150 in the rod 130 and will hold the rod in that position. It may be desirable to prevent an operator or exerciser from operating the steps at some of the higher speeds. In this case an adjustable screw 218 is mounted in an L-shaped bracket 220 attached to one side of the brace 157. The outer end of this screw 218 is shown in FIGS. 7 and 8 to the right of the brake drum 128. It is possible to adjust the screw 218 by moving it towards the left so that it will be impossible to move the brake to the right to some of the faster positions of the device.

Figure 15:
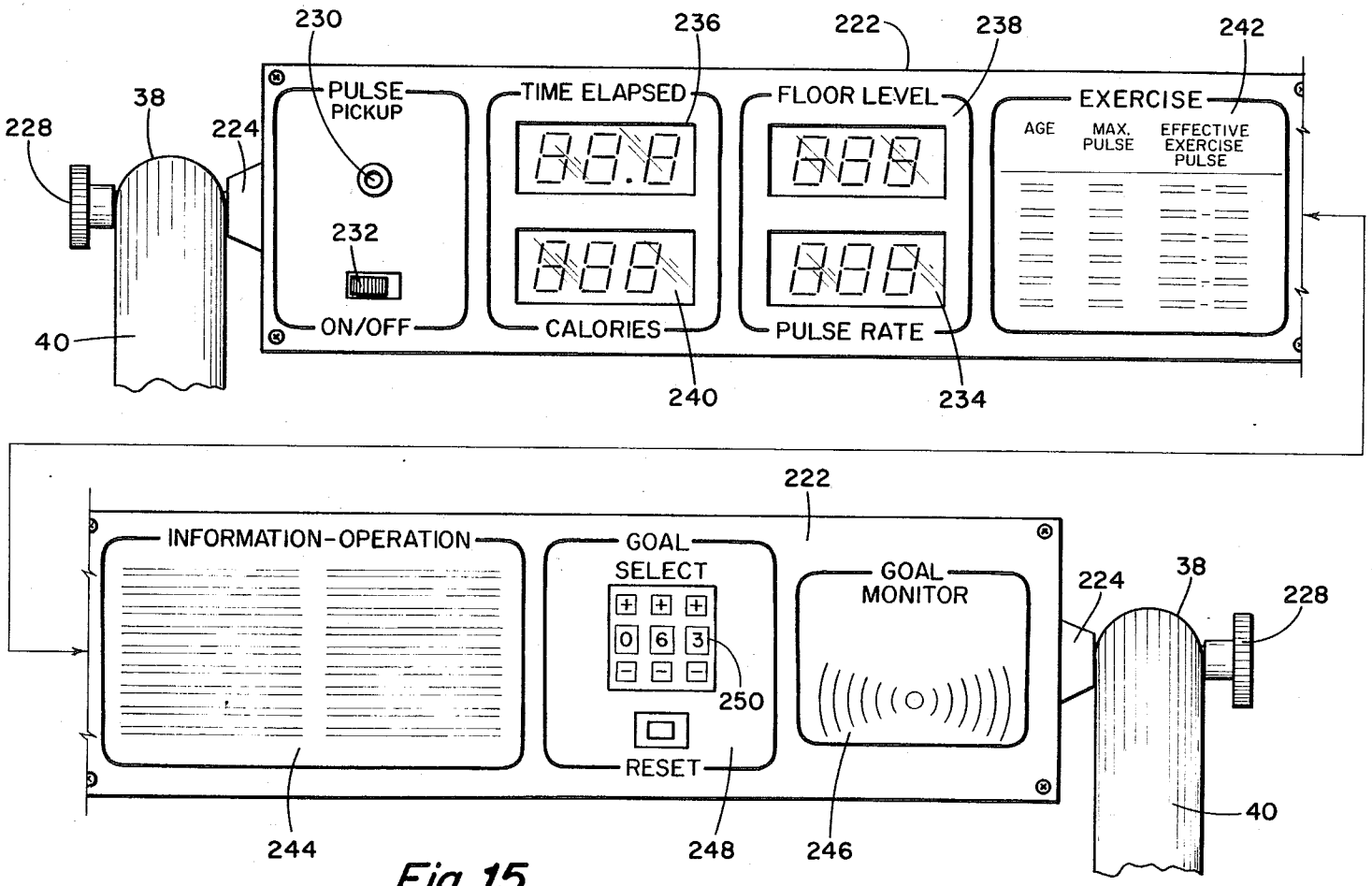
FIG. 15 is a front elevation, on an enlarged scale, and broken into two associated figure portions, of the control panel of FIG. 1 and taken along line 15—15 of FIG. 2.

A control or information panel 222, best shown in FIG. 15, is mounted between the two short horizontal tubular members 38 above the hand rails 40. The ends 224 of the control panel 222 are provided with shafts 226 which extend through the tubular members 38. Knurled nuts 228 are received on the threaded ends of the shafts 226 to hold the panel 222 in position. By use of these nuts 228 it is possible to tilt the panel 222, as desired. It is contemplated that some of the operators or exercisers may wish to have their pulse monitored in which case a conventional pulse monitoring device (not shown) will be worn by the exerciser. The end of the pulse monitoring device can be inserted into the socket 230 at the "pulse pick-up" portion of the panel 222, at the left side thereof. If the switch 232 is turned to the "on" position, the pulse rate can be observed in the digital readout 234 provided on the panel 222. Conventional electronic circuity (not shown) can be provided inside the panel 222 (or elsewhere) to convert the pulse pick-up into the pulse rate observed on the readout 234. An internal clock (not shown) can be provided in the panel 222 and it can be actuated in any conventional manner by a switch (not shown) so that the elasped time will appear on the digital readout 236. A micro switch (not shown) can be located at any convenient position along the frame so as to be actuated by a lug (not shown) on the chain 62 to pick up incremental distances representing the height of a floor. As an alternative to the micro switch, a reed switch (not shown) can be mounted at any convenient location on the frame so as to be activated by a magnet (not shown) located on any moving portion of the system such as the steps, one of the chains, or one of the sprockets such that the magnet would pass the reed switch periodically to actuate the same and indicate any desired incremental distance. The information from the micro switch (not shown) or from the reed switch (not shown) can be fed to the digital readout 238 to represent the distance which the steps move in terms of "floor level". The information fed into the digital readout 238 can be correlated with the weight of the exerciser by means of internal circuitry (not shown) to provide a readout on digital counter 240 to approximate the calories "burned" by the exerciser on reaching the floor level indicated by readout 238. The control panel 222 can also be provided with an information plate 242 which will correlate age and pulse information. Another general information plate 244 can also be provided on the control panel 222.

In order to provide encouragement for the exerciser, it is desirable that an audible "beep" be provided at the completion of each floor level. Accordingly, a "goal monitor" 246 is mounted on the control panel. Internal circuity (not shown) correlates with the information provided to the readout 238 to provide a short beep at the completion of each floor level. If, for example, the exerciser selects 63 floors as his goal, he can punch certain "plus" and "minus" buttons on a "goal select" portion 248 mounted on the panel 222 until the numbers "63" appear on the readout 250. Internal electronic circuity (not shown) mounted within the control panel 222 will cause the goal monitor 246 to emit a long "beep" after the exerciser has reached 63 floors.

Figure 4:
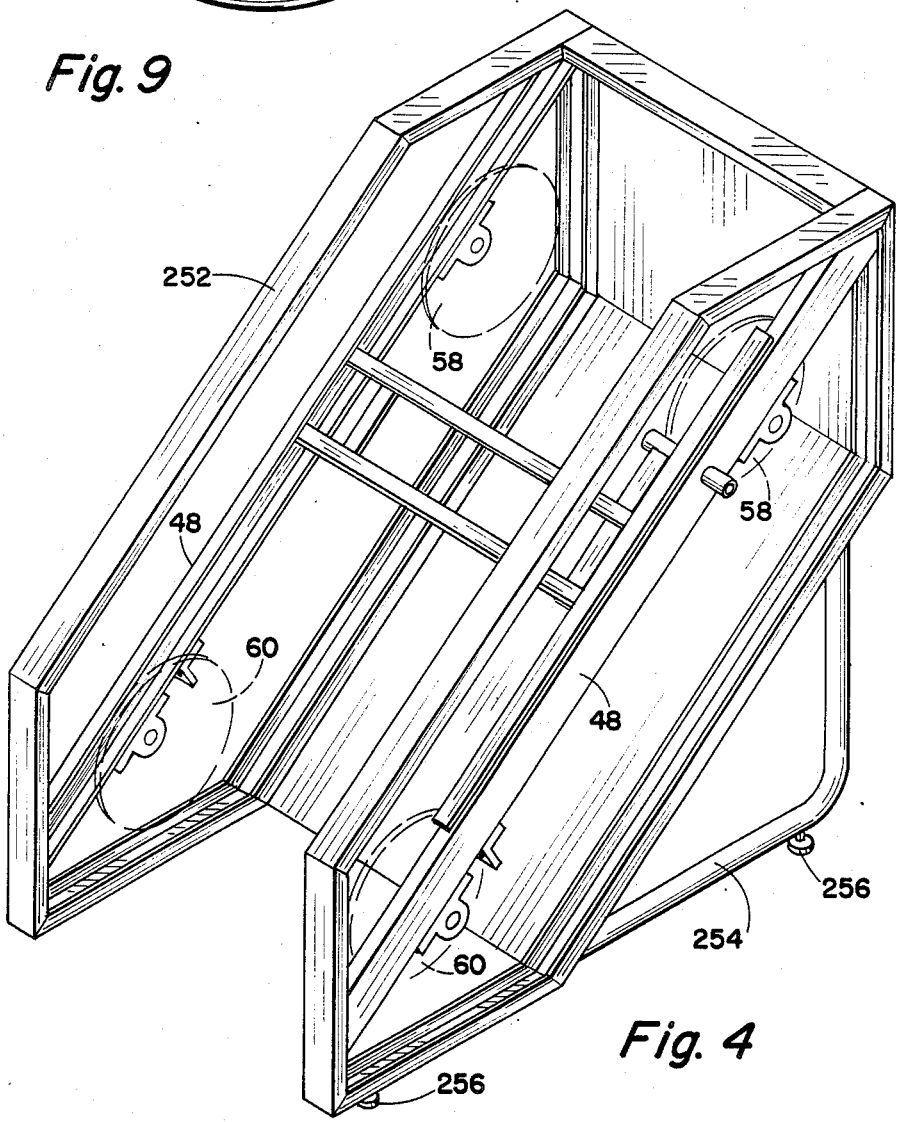
FIG. 4 is a perspective of a modified form of the frame but showing the positions of the sprockets in dashed lines.

FIG. 4 represents an alternate frame construction 252 which is functionally the same as the frame previously described but it might be cosmetically more attractive. The upper portion of the frame 252 will be essentially the same as the frame previously described and will be provided with the channel shaped inclined braces 48 as previously described. The sprockets 58 and 60 would be still located in essentially the same positions as indicated in dashed lines. The lower rear portion, however, would be modified to the extent that it would be open and L-shaped tubular members 254 would be provided with adjustable feet 256 at the front and rear of the frame.

When an operator or exerciser climbs onto the treadmill exerciser of the present invention and steps on the lowermost tread 82, his or her weight will cause the chain 62 shown in FIGS. 3 and 6 to move in a clockwise direction. The rollers 76 at the ends of the hinge shafts 74 will roll downward along the inclined plates or tracks 78. As the lowermost step proceeds downward, it may be necessary for the exerciser to move one of his feet to the next higher step and so forth. As the lowermost step proceeds around the lower sprocket 60 as shown in FIG. 3, the tread portion and the riser portion will pivot around their common hinge axis 86 to form an acute angle as shown; simultaneously, the step portion 82 will pivot clockwise around its inner hinge shaft 74 while the riser portion 84 will pivot counter-clockwise around its inner hinge shaft 74. Continued movement of the steps will cause the lowermost step to pass around the lower sprocket 62 to the next position indicated immediately to the left of this sprocket at which time the step portion 82 and the riser portion 84 have resumed their normal right angle relationship with each other. As the exerciser continues to step on the treads 82, the treads on the lower course of the chain will proceed upward towards the left end and "fold" around the upper sprocket 58 in the same manner as they did around the lower sprocket 60. Because of the double hinge action there will be no tendency for the tread plates 82 or the riser plates 84 to bend. As indicated heretofore, the speed with which the steps will move around the sprockets is determined by the position of the brake drum 128 with respect to the brake cylinder 118.

Whereas the present invention has been described in relation to the drawings attached hereto, it should be understood that other and further modifications, apart from those shown or suggested herein, may be made within the spirit and scope of this invention.

What is claimed is:

1. A treadmill exerciser having a frame shaped in the form of a staircase, a first sprocket shaft mounted for rotation around a substantially horizontal axis and journaled in the frame in the upper portion thereof and towards the rear thereof, a second sprocket shaft mounted for rotation around a substantially horizontal axis and journaled in the frame below and forward of said first sprocket shaft, a first pair of sprockets mounted on the ends of said first sprocket shaft for keyed rotation in spaced apart and substantially vertical planes, a second pair of sprockets mounted on the ends of said second sprocket shaft for keyed rotation in spaced apart and substantially vertical planes, a pair of continuous chains mounted adjacent the sides of said frame and drivingly engaging the first set of sprockets with the second set of sprockets, each chain being provided with a plurality equidistantly spaced apart hinge links, each hinge link being adapted to receive therethrough one end of a hinge shaft, the hinge links on each chain being in horizontal aligment with the hinge links on the other chain, a plurality of steps mounted on the chains and adapted to move therewith, each step having a normally vertical riser portion and a normally horizontal tread portion, the upper end of the riser portion of each step being connected to the forward end of the tread portion of said step by means of a first hinge, the lower end of each riser portion being connected to the rear of the tread portion of an adjacent step by means of a second hinge, a hinge shaft passing through each pair of aligned hinge links in said chains and through said second hinge, whereby when a person places his weight on a tread portion of a step adjacent the lower end of the frame, the steps will move in a downward direction along the upper course of the chains and in an upper direction along the lower course of the chains, and whereby when the person exerts his weight on the tread portion on successively higher steps, the steps will continue to move in a downward direction along the upper course of the chain and in an upper direction along the lower course of the chain such that the steps, as they traverse around the upper and lower sprockets, will fold at an acute angle around the first and second hinges.

2. A treadmill exerciser as set forth in claim 1 wherein said frame includes a pair of inclined tracks mounted adjacent the pair of chains, a roller mounted on the outer end of each hinge shaft, said rollers adapted to engage and roll along said tracks as the steps move downwardly with the upper course of said chains.

3. A treadmill exerciser as set forth in claim 1 including a speed control mechanism comprising an output shaft journaled for rotation in said frame, a flywheel keyed to said output shaft, means for driving said output shaft in response to the rotation of said sprocket shafts, a non-rotatable brake drum movably axially towards and away from said flywheel, a cylindrical plastic member connected to said flywheel and having a plurality of flexible plastic fingers thereon adapted to engage the inner surface of said brake drum, means for moving said brake drum towards and away from said flywheel whereby, in one axial position of said brake drum, the plastic fingers become partially disengaged from the inner surface of the frake drum to permit rapid step speed and whereby, when the brake drum is moved to an opposite axial position towards said flywheel, the plastic fingers firmly engage the inner surface of said brake drum to halt step movement.

4. A treadmill exerciser as set forth in claim 3 wherein a step-up transmission is provided in the means for driving the output shaft in response to the rotation of said sprockets.

5. A treadmill exerciser as set forth in claim 3 wherein an external control handle is mounted on the frame, a control shaft journalled for rotation in the frame and rotated by said control handle, and linkage means operated by said control shaft to move said brake drum axially with respect to said flywheel.

6. A treadmill exerciser as set forth in claim 1 wherein said frame is provided with a pair of tubular hand rails at the sides thereof and a control panel mounted at the top of the frame and adjacent the rear between the hand rails to provide operating, goal-setting, and health related information.

* * * * *